US010503188B2

(12) United States Patent
Ramos et al.

(10) Patent No.: US 10,503,188 B2
(45) Date of Patent: Dec. 10, 2019

(54) VOLTAGE REGULATOR AND METHOD FOR COMPENSATING THE EFFECTS OF AN OUTPUT IMPEDANCE

(71) Applicant: Dialog Semiconductor (UK) Limited, London (GB)

(72) Inventors: Carlos Zamarreno Ramos, Munich (DE); Frank Kronmueller, Neudenau (DE); Ambreesh Bhattad, Swindon (GB)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 16/223,174

(22) Filed: Dec. 18, 2018

(65) Prior Publication Data

US 2019/0187735 A1 Jun. 20, 2019

(30) Foreign Application Priority Data

Dec. 18, 2017 (DE) ..... 10 2017 223 082

(51) Int. Cl.
*G05F 1/575* (2006.01)

(52) U.S. Cl.
CPC ..... *G05F 1/575* (2013.01)

(58) Field of Classification Search
CPC ..... G05F 1/56; G05F 1/565; G05F 1/575
See application file for complete search history.

(56) References Cited

U.S. PATENT DOCUMENTS 6,603,292 B1 8/2003 Schouten et al.
7,843,180 B1 11/2010 Cilingiroglu
9,766,643 B1 9/2017 Cai et al.
2001/0028240 A1 10/2001 Fukui
2002/0105382 A1 8/2002 Kadanka
(Continued)

FOREIGN PATENT DOCUMENTS

DE 10 2016 207 714 11/2017
EP 2 520 998 11/2012

OTHER PUBLICATIONS

German Office Action, File Number: 10 2017 223 082.7, Applicant: Dialog Semiconductor (UK) Limited, dated Jul. 20, 2018, 12 pages and English language translation, 11 pages.

*Primary Examiner* — Gary L Laxton

(74) *Attorney, Agent, or Firm* — Saile Ackerman LLC; Stephen B. Ackerman

(57) ABSTRACT

A voltage regulator is presented. The output node of the voltage regulator is coupled to an output capacitor via a conductive path that exhibits a parasitic inductance. The voltage regulator has an output amplification stage for deriving the output current at the output node from the input voltage at the input node in dependence of a drive voltage at an intermediate node of the voltage regulator. The voltage regulator has an intermediate amplification stage for providing the drive voltage at the intermediate node based on a differential output voltage. A differential amplification stage determines the differential output voltage in dependence of the output voltage and in dependence of a reference voltage. The voltage regulator has a sensing unit to provide a load indication which is indicative of the output current and a variable impedance coupled to the intermediate node, where the variable impedance is dependent on the load indication.

17 Claims, 10 Drawing Sheets

(56) References Cited

U.S. PATENT DOCUMENTS

| | | | | |
|---|---|---|---|---|
| 2007/0159146 | A1 | 7/2007 | Mandal | |
| 2007/0216382 | A1 | 9/2007 | Lin et al. | |
| 2015/0253790 | A1* | 9/2015 | Gallina | G05F 1/46 323/293 |
| 2016/0266591 | A1 | 9/2016 | Hua et al. | |
| 2017/0090494 | A1 | 3/2017 | Cui et al. | |

* cited by examiner

VOLTAGE REGULATOR AND METHOD FOR COMPENSATING THE EFFECTS OF AN OUTPUT IMPEDANCE

TECHNICAL FIELD

The present document relates to a voltage regulator. In particular, the present document relates to a high bandwidth voltage regulator which is configured to compensate the effects of an output impedance.

BACKGROUND

Voltage regulators are frequently used for providing a load or output current at a stable load or output voltage to different types of loads (e.g. to the processors of an electronic device). A voltage regulator derives the output current from an input node of the regulator, while regulating the output voltage at the output node of the regulator in accordance to a reference voltage.

A voltage regulator is typically used in conjunction with an output capacitor which is external to the voltage regulator device and which is coupled to the output node of the voltage regulator via an electric and/or conductive path. Furthermore, the load is coupled to the output of the voltage regulator via an electric and/or conductive path. The conductive paths at the output of a voltage regulator, notably the parasitic inductances, in conjunction with the output capacitor may impact the stability of the voltage regulator, notably for relatively high load currents.

SUMMARY

The present document addresses the technical problem of improving the stability of a voltage regulator in view of parasitic inductances at the output of the voltage regulator. According to an aspect, a voltage regulator, notably a linear drop-output, LDO, voltage regulator, is described. The voltage regulator is configured to provide an output current (also referred to herein as a load current) at an output voltage at an output node of the voltage regulator, based on an input voltage at an input node of the voltage regulator.

The output node of the voltage regulator is coupled to an output capacitor via a conductive path that exhibits a parasitic inductance. The output capacitor and the parasitic inductance may form an LC circuit with an LC resonance frequency. This LC circuit may affect the stability of the voltage regulator, notably at relatively high output currents (e.g. 1 A, 1.5 A or more). The voltage regulator typically exhibits a particular bandwidth and/or a gain bandwidth (GBW) frequency. The bandwidth and/or GBW frequency typically increase with increasing output current. At relatively high output currents, e.g. at output currents which are at or above a pre-determined threshold current, the LC resonance frequency may fall within the bandwidth and/or may be smaller than the GBW frequency of the voltage regulator. In particular, the resonance of the LC circuit may lead to a bandwidth extension of the voltage regulator for output current which are at or above the threshold current. The threshold current may be dependent on the LC resonance frequency. The bandwidth extension caused by the parasitic inductance may affect the stability of the voltage regulator (notably for output currents at or above the threshold current).

The voltage regulator comprises an output amplification stage for deriving the output current at the output node from the input voltage at the input node in dependence of a drive voltage at an intermediate node of the voltage regulator. The output amplification stage typically comprises a pass transistor which couples the input node to the output node. By controlling the pass transistor (via the gate of the pass transistor), the level of the output current and/or of the output voltage may be set. The output amplification stage typically exhibits a frequency-dependent gain which is dependent on the level of the output current. The roll-off frequency of the frequency-dependent gain (and by consequence the bandwidth of the output amplification stage) typically increases with increasing level of output current.

Furthermore, the voltage regulator comprises at least one intermediate amplification stage for providing the drive voltage at the intermediate node based on a differential output voltage. The intermediate amplification stage typically exhibits a frequency-dependent gain, wherein the roll-off frequency of the gain of the intermediate amplification stage may be higher than the roll-off frequency of the gain of the output amplification stage (at least for output currents below the threshold current).

In addition, the voltage regulator comprises a differential amplification stage configured to determine the differential output voltage in dependence of the output voltage and in dependence of a reference voltage. The voltage regulator is typically configured to set the output voltage in dependence of the reference voltage. For this purpose, the voltage regulator may comprise a feedback network (comprising e.g. a voltage divider) configured to provide a feedback voltage which is dependent on (e.g. proportional to) the output voltage. The differential amplification stage may be configured to determine the differential output voltage in dependence of the feedback voltage and in dependence of the reference voltage (notably in dependence of a difference of the feedback voltage and the reference voltage).

The differential amplification stage typically exhibits a frequency-dependent gain with a certain roll-off frequency. Hence, the voltage regulator typically exhibits an overall frequency-dependent gain which is the result of an overlay of the gains of the differential amplification stage, the one or more intermediate amplifications stages and the output amplification stage. This overall frequency-dependent gain typically defines the stability of the voltage regulator. In particular, the bandwidth and/or the GBW frequency of this overall frequency-dependent gain may define the stability of the voltage regulator.

The voltage regulator comprises a sensing unit configured to provide a load indication which is indicative of the output current. The sensing unit may comprise one or more current mirrors which are configured to mirror the output current through the pass transistor, in order to provide the load indication. The load indication may be a current and/or a voltage which are proportional to the output current.

Furthermore, the regulator comprises a variable impedance which is coupled to the intermediate node. By doing this, the effective impedance of the voltage regulator at the intermediate node may be modified by the variable impedance. In particular, the variable impedance may be used to modify the frequency of a pole of the intermediate amplification stage (notably for relatively high output currents at or above the threshold voltage).

The variable impedance, notably a magnitude of the variable impedance, may be dependent on the load indication. In particular, the variable impedance may be such that the magnitude of the impedance is relatively low, if the load indication indicates a relatively high output current (e.g. at or above the threshold current). On the other hand, the magnitude of the impedance may be relatively high, if the load indication indicates a relatively low output current (e.g. below the threshold current). In a preferred example, the load current dependency and/or the magnitude of the variable impedance is set based on the LC resonance frequency.

Hence, a voltage regulator may be provided which is configured to modify the frequency of a pole of an intermediate amplification stage of the voltage regulator in dependence of the output current. By doing this, the stability of the voltage regulator may be ensured, even if the voltage regulator is affected by an LC resonance at the output node of the voltage regulator. Due to the load dependency of the adjustment of the pole of the intermediate amplification stage, stability can be achieved in a power efficient manner (without (significantly) increasing the quiescent current of the voltage regulator).

As indicated above, the intermediate amplification stage typically exhibits an amplification bandwidth. The bandwidth of the intermediate amplification stage is typically defined by the frequency of a pole of the intermediate amplification stage. The variable impedance may be such that the amplification bandwidth is reduced, if the load indication indicates a relatively high output current (e.g. an output current at or above the threshold current). Alternatively or in addition, the variable impedance may be such that the amplification bandwidth remains unaffected, if the load indication indicates a relatively low output current (e.g. an output current below the threshold current).

Alternatively or in addition, the intermediate amplification stage may exhibit a pole (which typically affects the amplification bandwidth of the intermediate amplification stage). The variable impedance may be such that a frequency of the pole is reduced, if the load indication indicates a relatively high output current (e.g. an output current at or above the threshold current). Alternatively or in addition, the variable impedance may be such that the frequency of the pole remains unaffected, if the load indication indicates a relatively low output current (e.g. an output current below the threshold current).

Hence, the variable impedance may be used to modify the frequency-dependent gain of the intermediate amplification stage in dependence of the output current, notably for relatively high output currents, e.g. output currents at or above the threshold current. By doing this, the stability of the voltage regulator may be ensured in a power efficient manner, notably for relatively high output currents.

As indicated above, the output capacitor and the parasitic inductance may form an LC circuit with an LC resonance frequency. The voltage regulator excluding the variable impedance (i.e. the voltage regulator without the effect of the variable impedance) may exhibit a bandwidth and/or a gain bandwidth frequency which increases with increasing output current, such that for an output current at or above the threshold current the LC resonance frequency falls within the bandwidth and/or the LC resonance frequency is smaller than the gain bandwidth frequency. As such, the resonance gain caused by the LC circuit may lead to a bandwidth extension of the voltage regulator excluding the variable impedance (at least for output currents at or above the threshold current).

On the other hand, for output currents below the threshold current, the LC resonance frequency may be higher than the bandwidth and/or higher than the gain bandwidth frequency of the voltage regulator excluding the variable impedance. Hence, the voltage regulator may not be (substantially) affected by the LC circuit for output currents which are below the threshold current.

The variable impedance may be such that for the voltage regulator including the variable impedance the LC resonance frequency is higher than the bandwidth and/or the gain bandwidth frequency of the voltage regulator at an output current at or above the threshold current. Hence, the variable impedance may decrease the bandwidth and/or the gain bandwidth frequency of the voltage regulator, such that the LC resonance frequency does not fall within the bandwidth of the voltage regulator anymore and/or such that the LC resonance frequency is greater than the GBW frequency of the voltage regulator (e.g. by 10%, 20% or more). By doing this, stability may be ensured for relatively high output currents.

Alternatively or in addition, the variable impedance may be such that the bandwidth and/or the gain bandwidth frequency of the voltage regulator including the variable impedance may (substantially) correspond to the bandwidth and/or the gain bandwidth frequency of the voltage regulator excluding the variable impedance for an output current below the threshold current. In particular, the deviation may be 10%, 5% or less for output currents below the threshold current. By doing this, stability and power efficiency may be maintained for relatively low output currents.

Alternatively or in addition, the voltage regulator excluding the variable impedance may have a frequency-dependent (open loop) gain for an output current at or above the threshold current, wherein the frequency-dependent gain exhibits a peak around the LC resonance frequency. In other words, the LC circuit at the output node of the voltage regulator may lead to a peak of the frequency-dependent (open loop) gain of the voltage regulator, thereby leading to a bandwidth extension for output currents at or above the threshold current.

The variable impedance may be such that the (open loop) gain of the voltage regulator including the variable impedance exhibits a reduced peak or no peak around the LC resonance frequency for an output current at or above the threshold current. In other words, the variable impedance may lead to an attenuation or removal of the peak caused by the LC circuit, thereby removing (at least partially) the bandwidth extension caused by the LC circuit. The peak may be reduced by 10%, 20% or more. By reducing the peak caused by the LC circuit, stability of the voltage regulator may be ensured in a reliable manner.

Alternatively or in addition, the variable impedance may be such that the (open loop) gain of the voltage regulator including the variable impedance (substantially) corresponds to the (open loop) gain of the voltage regulator excluding the variable impedance for an output current below the threshold current. In particular, the deviation may be 10%, 5% or less for output currents below the threshold current. By doing this, stability and power efficiency may be maintained for relatively low output currents.

The variable impedance may comprise a capacitor which is arranged in series with a variable resistance. The variable resistance may at least partially be provided by a control transistor having a variable on-resistance. The control transistor may be controlled based on the load indication, thereby controlling the variable resistance and the resulting impedance in an efficient and reliable manner.

The capacitance of the capacitor and/or the resistance of the variable resistance (e.g. the aspect ratio of the control transistor) may be selected in dependence of the LC resonance frequency, in order to ensure a reliable compensation of the effects of the LC circuit at relatively high output currents.

The variable resistance may be dependent on the load indication. The variable resistance may be relatively low, if the load indication indicates a relatively high output current (e.g. at or above the threshold current). Alternatively or in addition, the variable resistance may be relatively high, if the load indication indicates a relatively low output current (e.g. below the threshold current). By doing this, the stability of the voltage regulator may be ensured in a reliable and efficient manner.

The serial arrangement of the capacitor and the resistance may be arranged to couple the intermediate node to a reference potential of the voltage regulator, notably to ground. Typically, the input voltage and the output voltage are also relative to the reference potential of the voltage regulator. Hence, the overall impedance at the output of the intermediate amplification stage may be controlled and/or adjusted in a reliable manner, in order to ensure the stability of the voltage regulator at relatively high output currents.

The output amplification stage may comprise a drive transistor which forms a current mirror with the pass transistor. The output current may correspond to the current through the pass transistor. Furthermore, the output amplification stage may comprise a first transistor which is arranged in series with the drive transistor and which forms a current mirror with a second transistor. In addition, the output amplification stage may comprise a third transistor which is controlled based on the drive voltage at the intermediate node and which is arranged in series with the second transistor. The transistors may be metaloxide semiconductor (MOS) field effect transistors (FETs). The load indication may depend on, notably may correspond to, a voltage level of the gates of the first and second transistors. By doing this, a load indication of the output current may be provided in a precise and efficient manner.

The gate of the control transistor may be coupled to the gates of the first and second transistors, in order to control the variable resistance and/or the variable impedance based on the load indication. By doing this, the variable impedance may be reduced with increasing output current and/or the variable impedance may be increased with decreasing output current.

The sensing unit may comprise a sensing transistor having a gate that is coupled to the gates of the first and second transistors and being arranged in series with a sensing resistor. The gate of the control transistor may be coupled to a midpoint between the sensing transistor and the sensing resistor. The value of the sensing resistor may be used to set the threshold current. By using a sensing transistor and a sensing resistor, the impact of the variable impedance on the voltage regulator, notably on the open loop gain and/or on the GBW frequency, may be set in a relatively abrupt manner for output currents at or above the threshold current. As a result of this, the stability of the voltage regulator at relatively high output currents may be ensured, while keeping the behavior of the voltage regulator unaffected for output current below the threshold current.

According to a further aspect, a method for operating a voltage regulator is described. In particular, a method for compensating effects of a parasitic inductance at an output of a voltage regulator is described. As described in the present document, the voltage regulator is configured to provide an output current at an output voltage at an output node of the voltage regulator, based on an input voltage at an input node of the voltage regulator. The output node of the voltage regulator is coupled to an output capacitor via a conductive path that exhibits the parasitic inductance. The voltage regulator comprises an output amplification stage for deriving the output current at the output node from the input voltage at the input node in dependence of a drive voltage at an intermediate node of the voltage regulator. Furthermore, the voltage regulator comprises an intermediate amplification stage for providing the drive voltage at the intermediate node based on a differential output voltage. In addition, the voltage regulator comprises a differential amplification stage configured to determine the differential output voltage in dependence of the output voltage and in dependence of a reference voltage. The method comprises determining a load indication which is indicative of the output current. Furthermore, the method comprises setting an impedance at the intermediate node based on the load indication.

In the present document, the term "couple" or "coupled" refers to elements being in electrical communication with each other, whether directly connected e.g., via wires, or in some other manner.

SHORT DESCRIPTION OF THE FIGURES

The invention is explained below in an exemplary manner with reference to the accompanying drawings, wherein FIG. 1A illustrates an example block diagram of an LDO regulator;

DETAILED DESCRIPTION

Figure 1A:
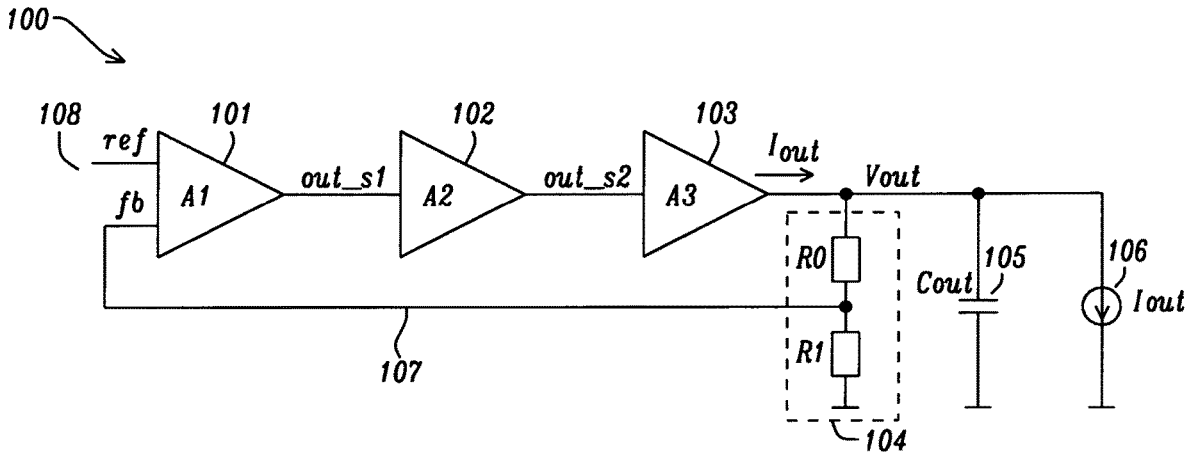
FIG. 1A Prior Art
FIG. 1B illustrates the example block diagram of an LDO regulator in more detail.

As outlined above, the present document is directed at providing a power efficient and stable voltage regulator, even in the presence of a parasitic inductance at the output of the voltage regulator. An example of a voltage regulator is an LDO regulator. A typical LDO regulator 100 is illustrated in FIG. 1A. The LDO regulator 100 comprises an output amplification stage or output stage 103, comprising e.g. a field-effect transistor (FET), at the output and a differential or first amplification stage 101 (also referred to as error amplifier) at the input. A first input (fb) 107 of the differential amplification stage 101 receives a fraction of the output voltage $V_{OUT}$ determined by the voltage divider 104 comprising resistors R0 and R1. The second input (ref) to the differential amplification stage 101 is a stable voltage reference $V_{ref}$ 108 (also referred to as the bandgap reference). If the output voltage $V_{OUT}$ changes relative to the reference voltage $V_{ref}$ (or to a setpoint voltage proportional to the reference voltage), the drive voltage to the output amplification stage, e.g. to the power FET, changes by a feedback mechanism called main feedback loop to maintain a constant output voltage $V_{OUT}$.

The LDO regulator 100 of FIG. 1A further comprises an additional intermediate amplification stage 102 configured to amplify the differential output voltage of the differential amplification stage 101. An intermediate amplification stage 102 may be used to provide an additional gain within the amplification path. Furthermore, the intermediate amplification stage 102 may provide a phase inversion.

In addition, the LDO regulator 100 is typically used in conjunction with an output capacitance $C_{out}$ (also referred to as output capacitor or stabilization capacitor) 105 parallel to the load 106. The output capacitor 105 is used to stabilize the output voltage $V_{OUT}$ subject to a change of the load 106, in particular subject to a change of the requested load current or output current $I_{load}/I_{OUT}$. The capacitor value or capacitance of the output capacitor 105 may be selected depending on the application.

Figure 1B:
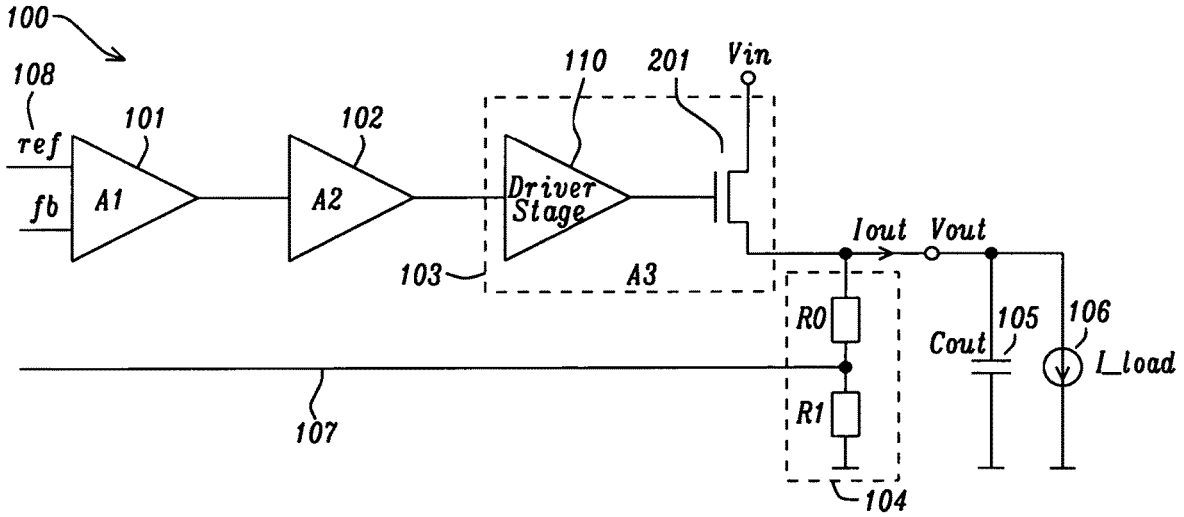
FIG. 1B Prior Art

FIG. 1B illustrates the block diagram of a LDO regulator 100, wherein the output amplification stage 103 is depicted in more detail. In particular, the pass transistor or pass device 201 and the driver stage 110 of the output amplification stage 103 are shown. Typical parameters of an LDO regulator 100 are a supply voltage of 3V, an output voltage of 2V, and an output current or load current ranging from 1 mA to 100 or 200 mA and even up to very high output currents of 1 A, 1.5 A or more. Other configurations are possible.

Figure 2A:
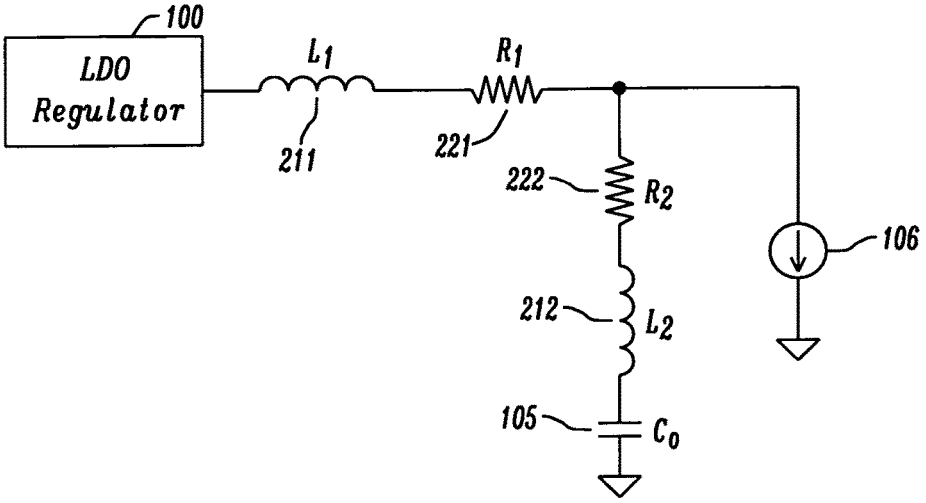
FIG. 2A Prior Art
FIG. 2A shows example parasitic inductances at the output of a voltage regulator.

The connection of the output capacitor 105 and the output port of a voltage regulator 100 is typically implemented at board level, leading to parasitic inductances in the signal path in series with the output capacitor 105. A typical equivalent circuit for such a situation is shown in FIG. 2A. In particular, FIG. 2A shows the parasitic inductances 211, 212 and the resistances 221, 222 of the conductive paths for coupling the output capacitor 105 and the load 106 to the output node of the voltage regulator 100.

When dealing with a voltage regulator 100 for relative high output currents and relatively high bandwidth, the LC resonance frequency of the LC circuit created by the parasitic inductances 221, 222 (in conjunction with the output capacitor 105) may fall within the gain bandwidth (GWB) frequency of the voltage regulator 100 in case of relatively high output currents (e.g. 1 A, 1.5 A or more). This LC resonance degrades the phase margin such that the voltage regulator 100 may become unstable. In particular, the GBW frequency of the resulting voltage regulator 100 (including the LC circuit) may be pushed to much higher frequencies due to the resonance peaking, thereby reducing the stability margins.

The present document is directed at improving the stability of a voltage regulator 100 at very high load currents, while minimizing the current and/or power consumption of the voltage regulator 100. In particular, a method for modifying one or more pole and/or zero locations (i.e. frequencies) of the voltage regulator 100 is described in order to cope with the external LC resonance frequency contribution and in order to increase the phase margin.

One possible solution for stabilizing the voltage regulator 100 is designing the voltage regulator 100 such that the internal poles are pushed to the highest possible frequency. In view of the fact that the GBW frequency can become very high, this cannot typically be achieved at a reasonable quiescent current consumption and/or power efficiency for the voltage regulator 100.

Stability and power efficiency in combination can be achieved by controlling the position (i.e. the frequency) of an internal pole of the voltage regulator 100, notably a pole which is located at a relative high frequency, depending on the load conditions (notably the load current) of the voltage regulator 100.

For light and medium load currents, the LC resonance frequency of the LC circuit at the output of the voltage regulator 100 is typically higher than the GBW frequency of the voltage regulator 100. As a result of this, the LC resonance frequency does not affect the stability of the voltage regulator 100. Hence, the pole and/or zero configuration of the voltage regulator 100 may remain unchanged for light and medium load currents. In particular, all non-dominant poles of the voltage regulator 100 may be kept at the maximum frequency.

On the other hand, for heavy load currents (at or above a threshold current), the effect of the LC resonance on the stability of the voltage regulator 100 may be compensated by moving at least one of the internal poles of the voltage regulator 100 to lower frequencies. As a result of this, the moved pole causes a steeper roll-off of the magnitude of the total gain of the voltage regulator 100, thereby compensating at least partially the zero effect of the LC resonance.

Hence, the voltage regulator 100 may comprise means for controlling the frequency and/or the position of an internal pole of the voltage regulator 100 in dependence of the load current. By doing this, the stability of the voltage regulator 100 can be achieved in a power efficient manner.

Figure 2B:
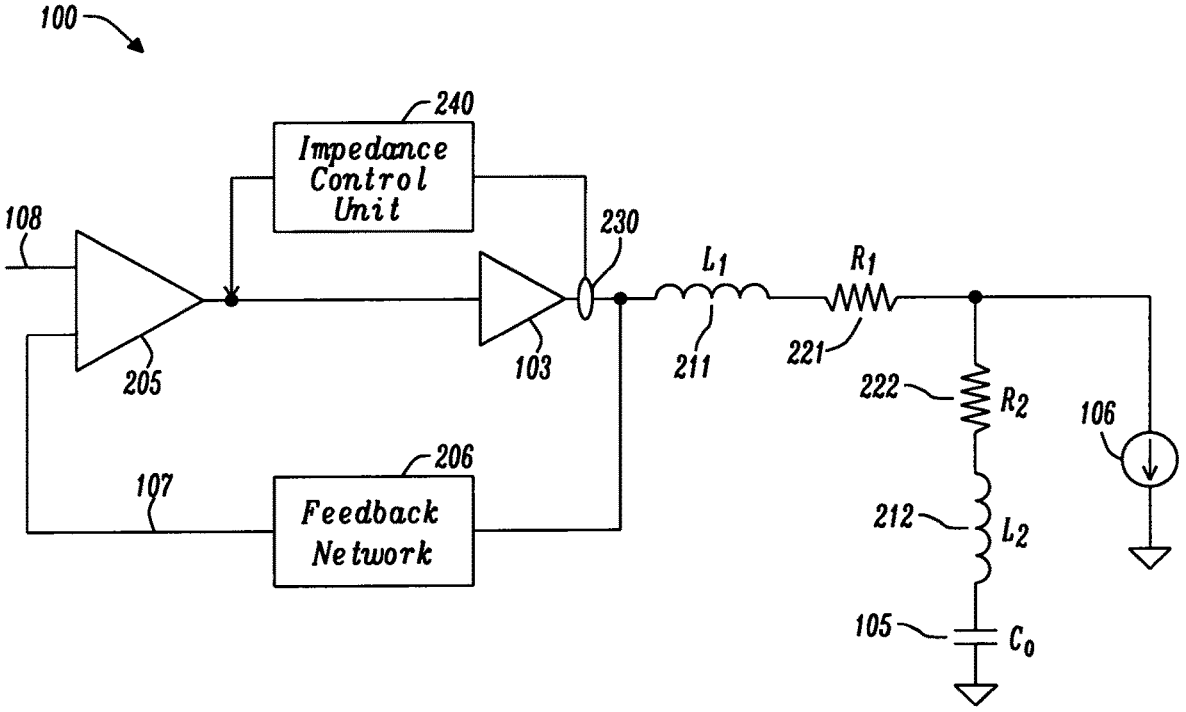
FIG. 2B shows an example block diagram of a compensation loop for compensating the effects of a parasitic inductance.

The frequency of an internal pole of the voltage regulator 100 may be controlled by loading the output of an internal stage 205 of the voltage regulator 100 (e.g. the output of the intermediate stage 102) with a voltage and/or current controlled impedance element. FIG. 2B shows a compensation loop comprising a current sensing unit 230 which is configured to provide a load indication of the load current at the output of the voltage regulator 100. Furthermore, the compensation loop comprises an impedance control unit 240 for controlling an impedance at the output of the internal stage 205 of the voltage regulator 100. In addition, FIG. 2B shows the feedback loop for feeding back the output voltage of the voltage regulator 100 to the input of the differential amplification stage 101 using a feedback network 206 (comprising e.g. the voltage divider 104).

Figure 2C:
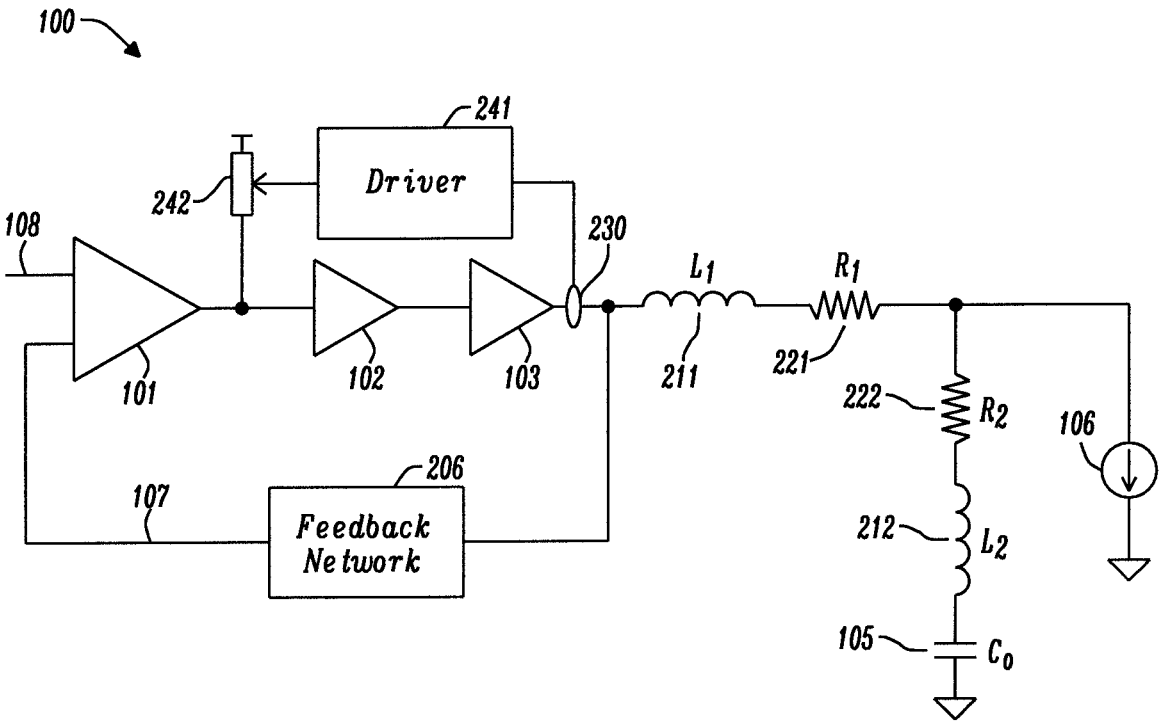
FIG. 2C shows an example controllable impedance for a compensation loop.
Figure 2D:
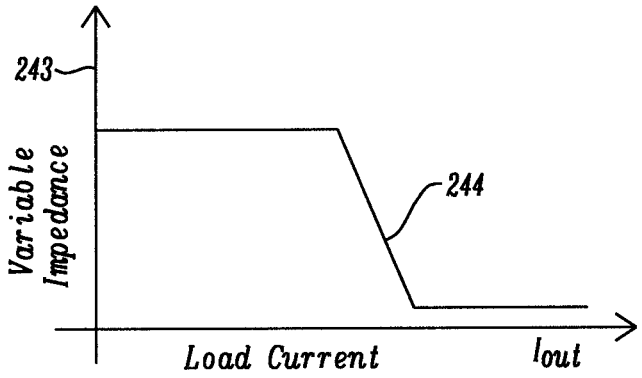
FIG. 2D shows an example current dependent magnitude of a controllable impedance.

FIG. 2C shows the impedance control unit 240 in more detail. In particular, the impedance control unit 240 may comprise a driver unit 241 which is configured to set (the magnitude of) a variable impedance 242, in dependence of the load indication. FIG. 2D illustrates an example curve 244 of the magnitude 243 of the variable impedance 242 as a function of the load current. The magnitude 243 of the impedance 242 drops at a threshold current, thereby decreasing the overall gain of the voltage regulator 100 for compensating the effects of the LC resonance at the output of the voltage regulator 100. The threshold current typically depends on the LC resonance frequency of the LC circuit at the output of the voltage regulator 100. In other words, the curve 244 of the magnitude 243 of the variable impedance 242 is typically designed in dependence of the LC resonance frequency.

The compensation loop typically comprises a sensing circuit or sensing unit 230 for sensing the output and/or load current of the voltage regulator 100. This circuit 230 may provide a load indication (e.g. a current and/or a voltage)

which is proportional to the load current. The load indication can be used to control the frequency of an internal pole of the voltage regulator 100 in dependence of the load current.

Furthermore, the compensation loop may comprise a driver 241 for controlling the variable impedance 242. The driver 241 may translate the load indication into a signal which controls the impedance 242.

In addition, the compensation loop may comprise a voltage and/or current controlled impedance 242. The (magnitude 243 of the) impedance 242 may be relatively high for relative low and/or moderate load currents, in order to not affect the loop dynamics of the voltage regulator 100. On the other hand, the (magnitude 243 of the) impedance 242 may be low at relatively high load currents, in order to modify the internal pole of the voltage regulator 100.

Figure 3A:
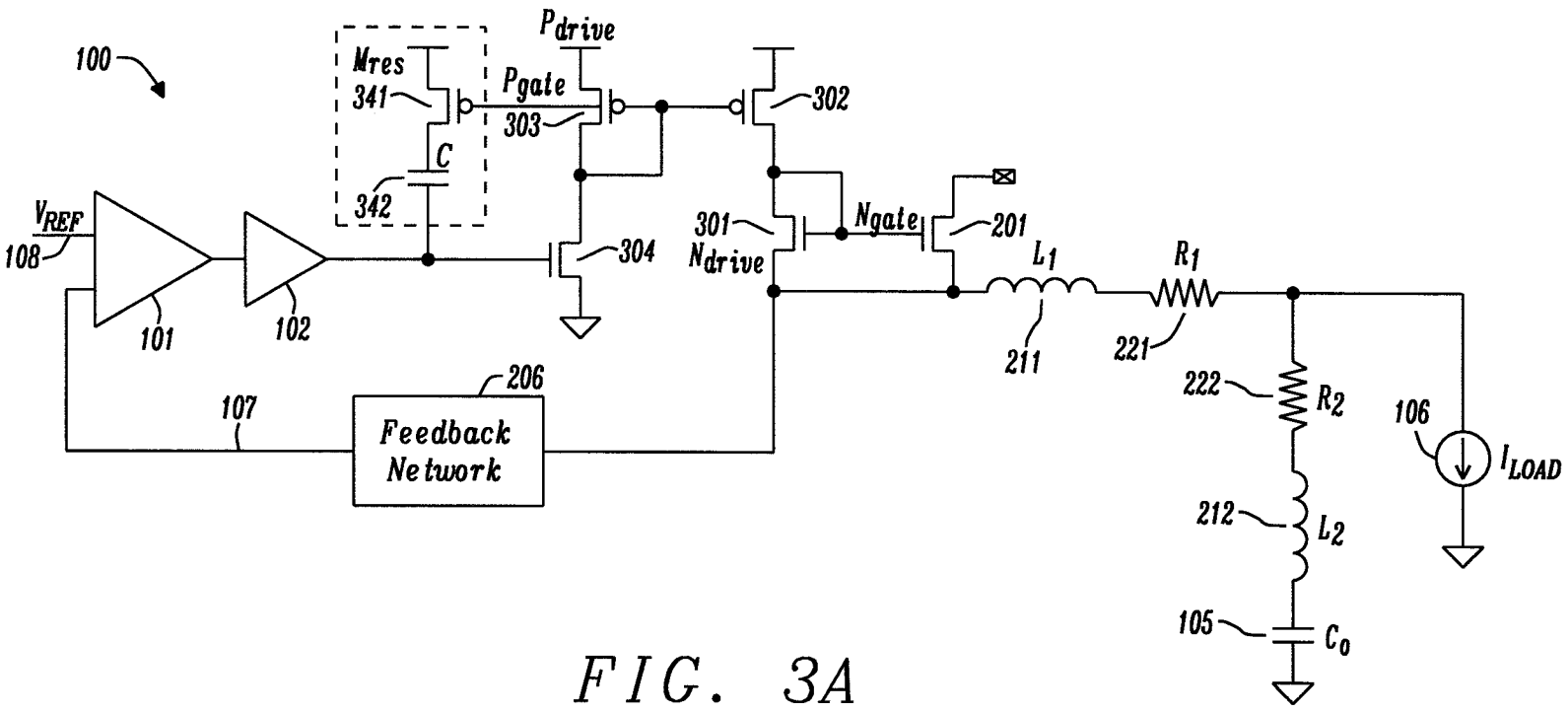
FIG. 3A shows an example voltage regulator with a compensation loop.

FIG. 3A shows an example circuit diagram of a voltage regulator 100 with an NMOS pass transistor 201, for which the bandwidth can be extremely high in case of high load currents. It should be noted that the schemes which are outlined in the present document are also applicable to other types of voltage regulators 100.

The driver stage 110 of the voltage regulator 100 comprises a drive transistor 301 for driving the pass transistor 201, wherein the drive transistor 301 and the pass transistor 201 form a current mirror. Furthermore, the driver stage 110 comprises transistors 302, 303, 304 for coupling the input of the driver stage 110 (and the output of the intermediate amplification stage 102) with the drive transistor 301, using a (PMOS) current mirror formed by the transistors 302, 303. The current through the drive transistor 301 is proportional to the load current. Due to the fact that the drive transistor 301 and the transistor 302 are arranged in series, the current through the first transistor 302 is typically indicative of (e.g. proportional to) the load current. Hence, using a control transistor 341 which forms a (PMOS) current mirror with the first transistor 302, a load indication may be provided at the control transistor 341.

Hence, the gate voltage of the Pdrive stage (buffer) may be used to drive the variable on-resistance of a control transistor 341 to provide a load indication. As the current trough the PMOS current mirror is typically proportional to the load current, the voltage at the Pgate comprises information about the load current and can be used to control the on-resistance Ron of a PMOS device, i.e. of the control transistor 341.

When the load is relatively light, the Pgate voltage is close to the supply voltage and the on-resistance Ron of the control transistor 341 Mres is relatively high. In this condition, the capacitor 342 (forming the controllable impedance 242) is virtually disconnected from the output node and the frequency response of the loop of the voltage regulator 100 is not affected. However, when the load increases, Pgate decreases and the on-resistance Ron of the control transistor 341 Mres decreases as well, thereby connecting the capacitor 342 to the loop via the control transistor 341 Mres. As a result of this, the pole of the second and/or intermediate amplification stage 102 moves to a lower frequency, thereby compensating (at least partially or fully) the peak created by the LC resonance frequency.

Figure 3B:
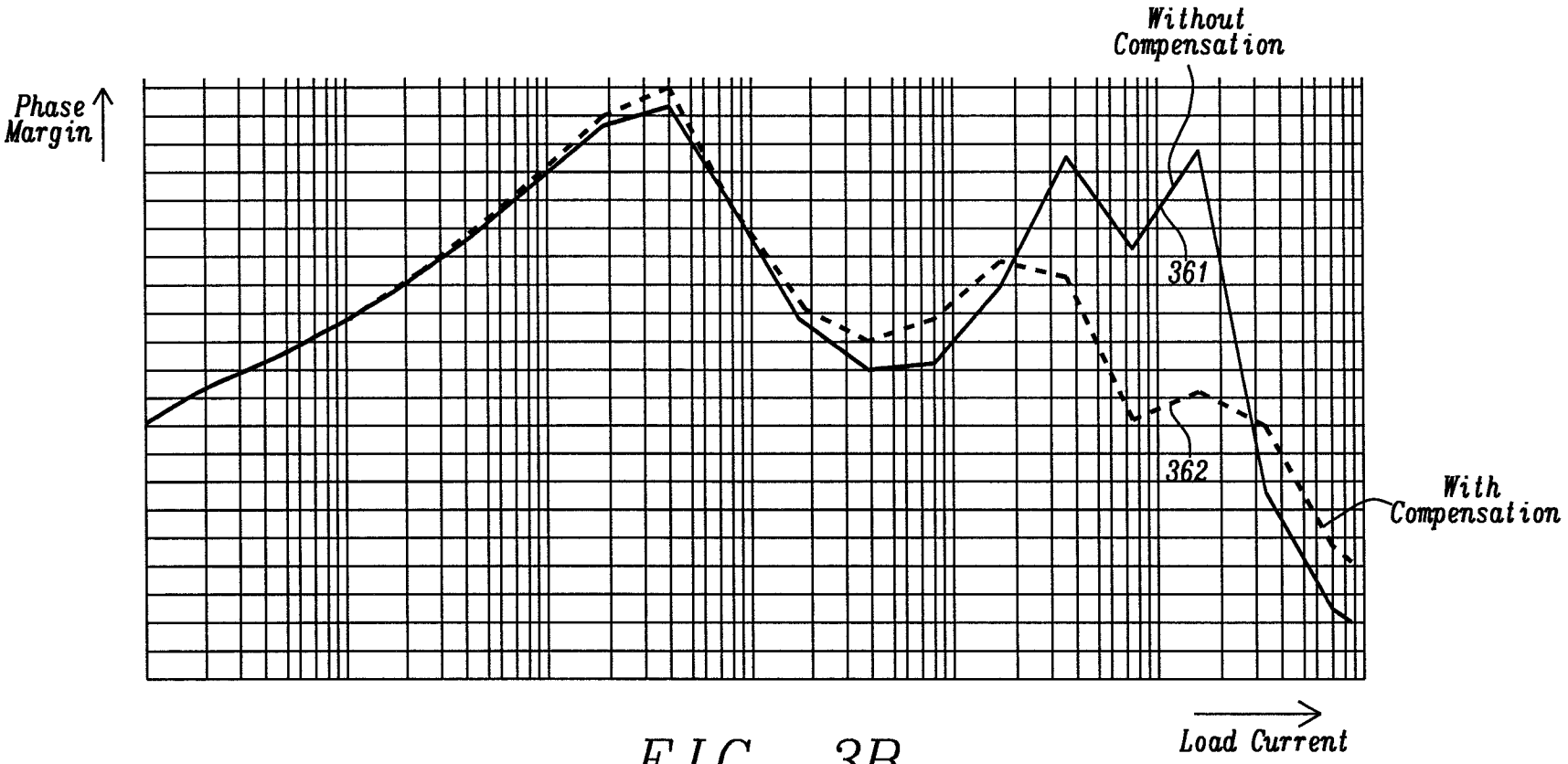
FIG. 3B illustrates the phase margin of a voltage regulator comprising a compensation loop.

FIG. 3B shows the phase margin of the voltage regulator 100 as a function of the load current (from 1 μA up to 1.5 A) for the voltage regulator 100 without compensation loop (curve 361) and for the voltage regulator 100 with compensation loop (curve 362). It can be seen that the phase margin is increased for relatively heavy load currents, while maintaining the current consumption of the voltage regulator 100 unaltered. As a matter of fact, the implementation of the compensation loop shown in FIG. 3A does not consume any DC current.

The compensation loop of FIG. 3A provides a relatively smooth variation of the on-resistance Ron of the control transistor 341. As a result of this, the phase margin of the voltage regulator 100 may be decreased for medium load currents, for which the LC resonance frequency is at frequencies higher than the bandwidth of the voltage regulator 100, such that it does not affect the stability of the voltage regulator 100. A modification of the behavior of the voltage regulator 100 caused by the variable impedance 242 may be undesirable for medium load currents.

Figure 4:
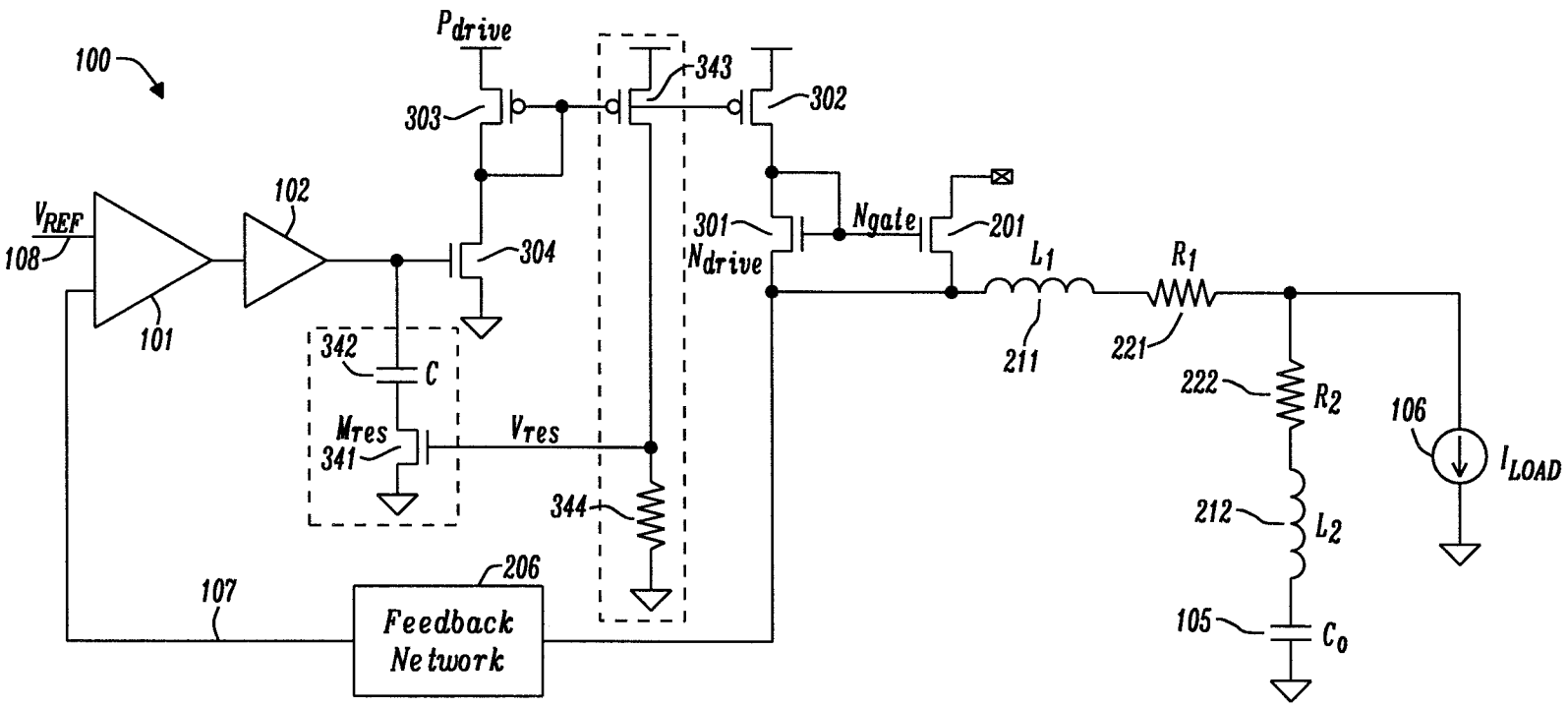
FIG. 4 show another example voltage regulator with a compensation loop.

FIG. 4 shows a voltage regulator 100 with a compensation loop which controls the on-resistance Ron of the control transistor 341 in a relatively steep manner, in order avoid the phase margin degradation at medium load currents. A steep control of the gate of the control transistor 341 may be used to provide a high impedance 242 when the compensation is not needed (at load currents below the threshold current) and low impedance 242 when the LC resonance affects the stability of the voltage regulator 100 (at load currents at or above the threshold current).

The load indication regarding the load current is sensed using a replica device 343 (also referred to herein as a sensing transistor) which mirrors the current flowing through the Pdrive transistor 303 (wherein this current is typically proportional to the load current) to a sensing resistor 344. The division ratio of the current mirror formed by the transistors 303, 343 is preferably relatively high in order to reduce the power consumption through the sensing resistor 344. In view of the fact that the current through the sensing resistor 344 is proportional to the load current, the efficiency of the voltage regulator 100 is only marginally affected at all possible load currents.

Depending on the level of the load current, a certain voltage drop is generated across the sensing resistor 344. This voltage drop changes the on-resistance Ron of the control transistor 341 only when the voltage drop goes above the threshold voltage of the control transistor 341. The compensation loop of FIG. 4 leads to a relatively abrupt transition between the compensation and the non-compensation modes, thereby reducing the impact of the compensation loop at moderate load currents.

The compensation loop may be adapted to different values of the parasitic inductance 211, 212 by adapting the value of the capacitor 342 and/or by adapting the aspect ratio of the control transistor 341 in dependence of the value of the parasitic inductance 211, 212. Hence, the voltage regulator 100 may be stabilized in a flexible and efficient manner for different parasitic inductance conditions.

As outlined in the present document, high current voltage regulators 100, notably LDOs, may exhibit a very large bandwidth and may be highly sensitive to the parasitic behavior of passive components. In particular, a parasitic inductance 211, 212 may generate an LC resonance in conjunction with the output capacitor 106, thereby degrading the stability of the voltage regulator 100, if the LC resonance frequency falls within the bandwidth of the voltage regulator 100 (which may be the case at relative high load currents).

In the present document, a high bandwidth voltage regulator 100 is described, wherein the output node of the voltage regulator 100 is coupled to an output inductance 211, 212 and an output capacitor 105, which may create an LC resonance within the bandwidth of the voltage regulator 100. The voltage regulator 100 comprises a sensing unit 230 which is configured to sense the output current of the voltage regulator 100 in order to provide a load indication which is indicative of the output current. Furthermore, the voltage regulator 100 comprises an impedance 242 which can be controlled in dependence of the load indication, in particular in dependence of a current and/or voltage which is proportional to the output current. In addition, the voltage regulator 100 comprises an internal amplification stage 102 having a relatively high impedance. The bandwidth of this internal amplification stage 102 may be controlled using the variable and/or controllable impedance 242. By doing this, the voltage regulator 100 may be stabilized in the presence of relatively large parasitic inductances 211, 212, even for very high load currents. This can be achieved without (significantly) increasing the current consumption and without (significantly) degrading the power efficiency of the voltage regulator 100.

Figure 5:
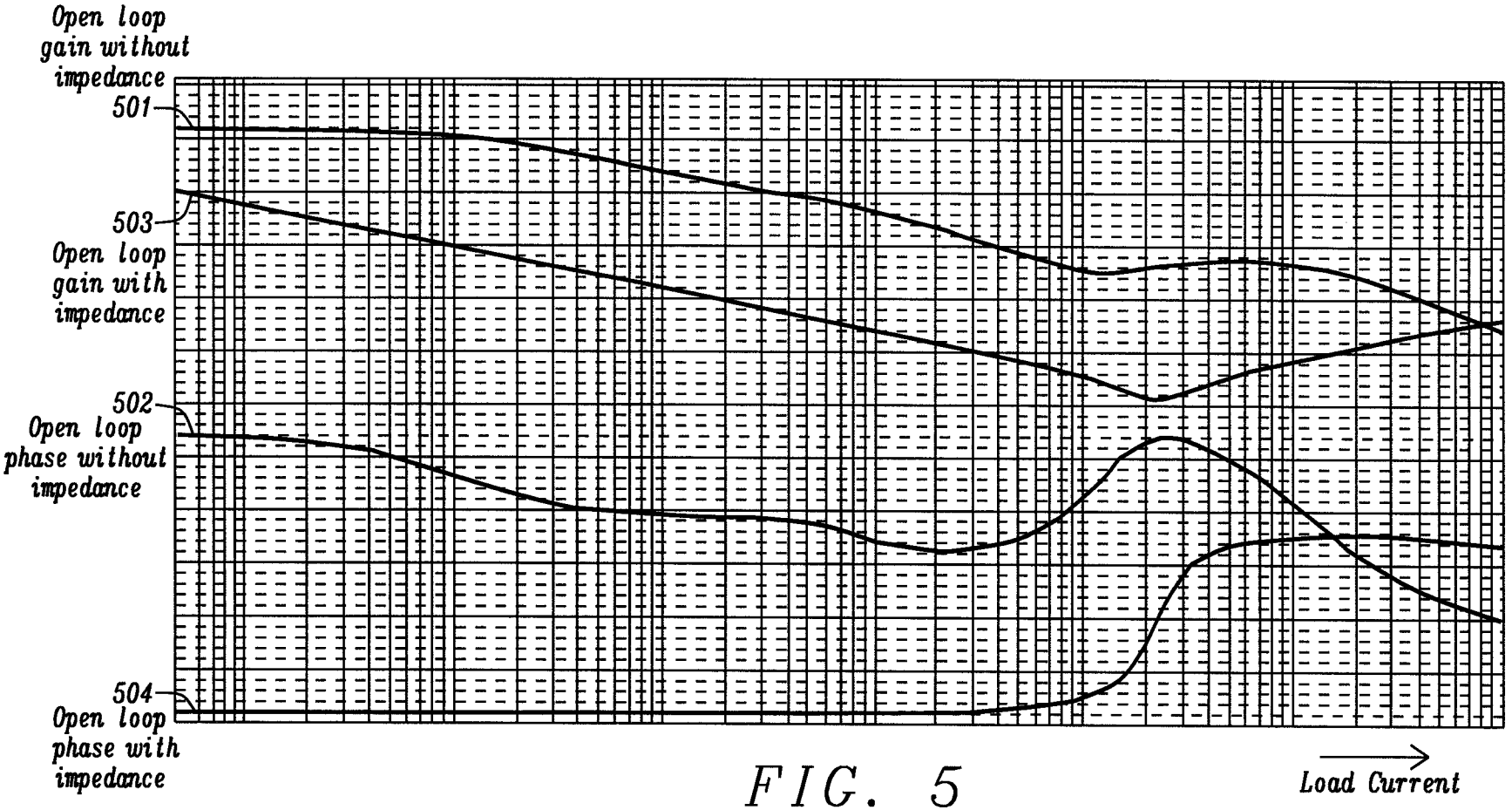
FIG. 5 illustrates the gain and the phase impact of a compensation loop on the overall gain and phase of a voltage regulator.

FIG. 5 illustrates the open loop gain of a voltage regulator 100 (magnitude 501 and phase 502). Furthermore, FIG. 5 illustrates the contribution of the impedance 242 (magnitude 503 and phase 504). It can be seen that due to the impedance 242, the magnitude of the overall gain of the voltage regulator 100 is decreased and the phase margin is increased for relatively high load currents, thereby increasing the stability of the voltage regulator 100.

Figure 6A:
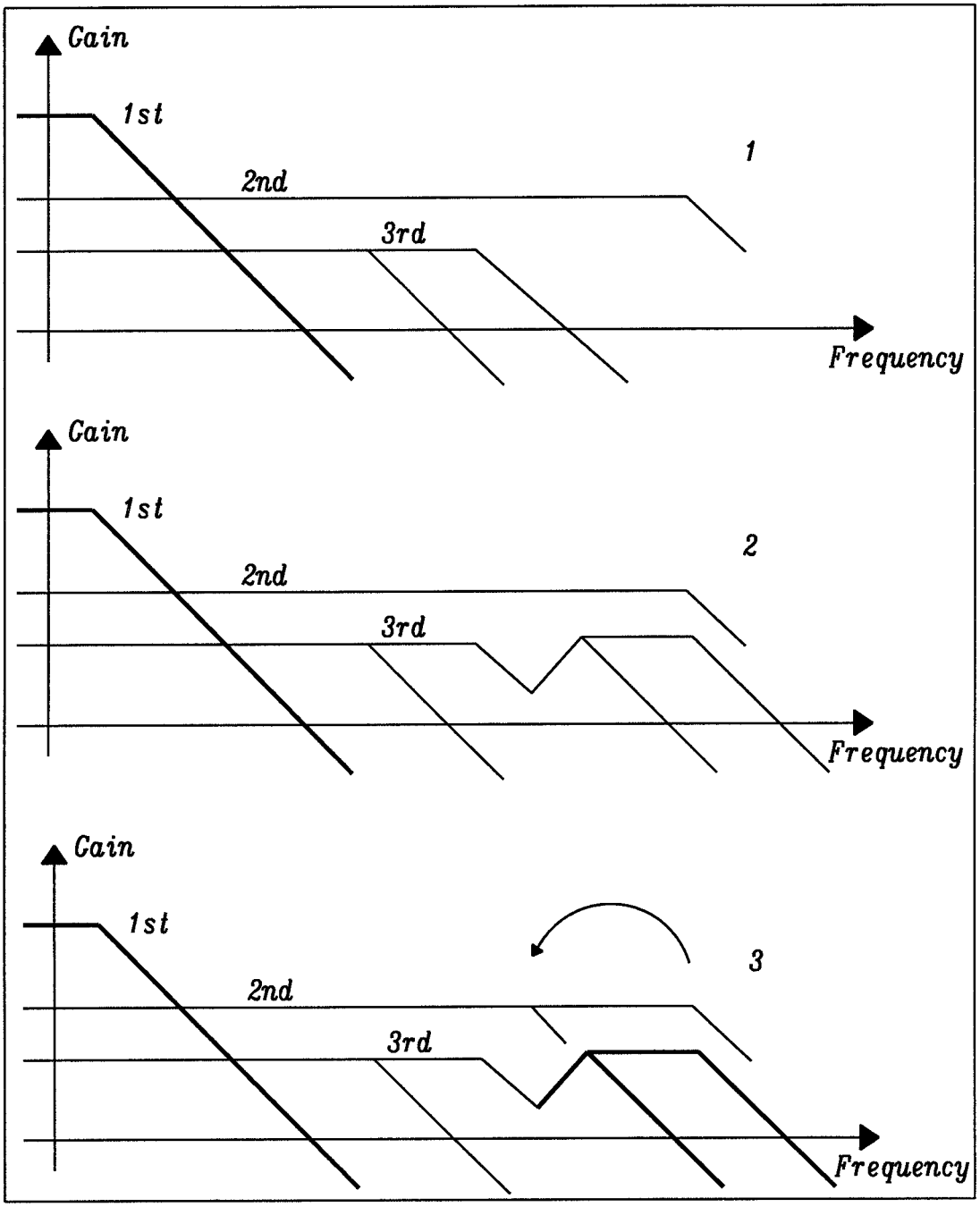
FIG. 6A illustrates the frequency-dependent gains of the different amplification stages of a voltage regulator.
Figure 6B:
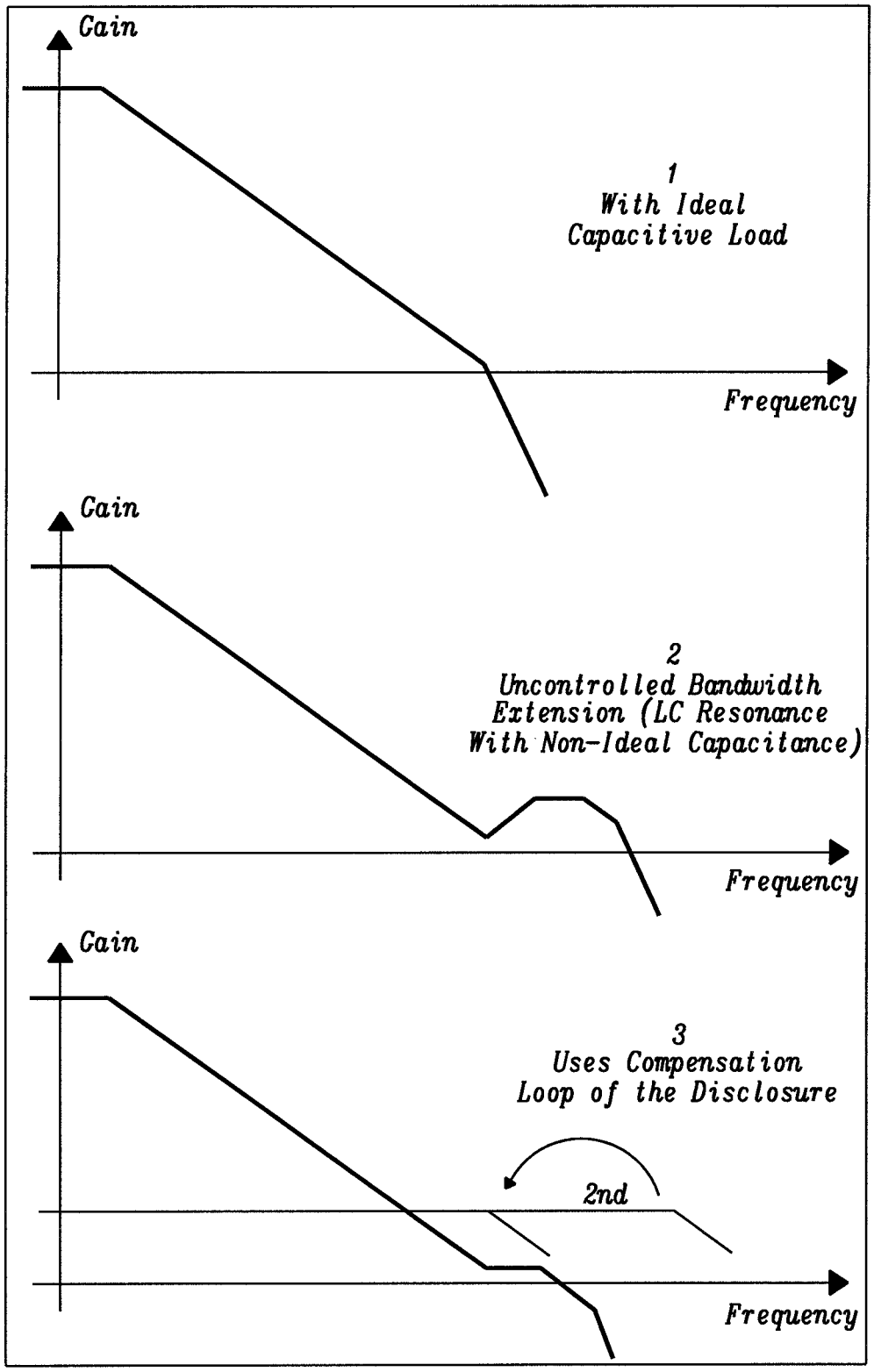
FIG. 6B illustrates the total gain of a voltage regulator comprising a compensation loop.

The effect of the compensation loop on the stability of the voltage regulator 100 is further illustrated in FIGS. 6A and 6B. The voltage regulator 100 comprises a differential (first) amplification stage 101, an output (e.g. a third) amplification stage 103 and one or more intermediate (e.g. $2^{nd}$) amplification stages 102. FIG. 6A (1) illustrates the magnitude of the gain of the differential amplification stage 101 ($1^{st}$), the magnitude of the gain of the intermediate amplification stage 102 ($2^{nd}$) and the magnitude of the gain of the output stage 103 ($3^{rd}$) as a function of frequency for a voltage regulator 100 without a compensation loop. The frequency diagram of the magnitude of the gain of the output stage 103 typically depends on the load current. In particular, the roll-off of the magnitude of the gain of the output stage 103 typically increases with increasing load current.

For very high load currents (e.g. 1 A, 1.5 A or more), the voltage regulator 100 may be affected by an LC resonance of an LC circuit at the output of the voltage regulator 100. This may lead to a bandwidth extension of the output amplification stage 103 as illustrated in FIG. 6A (2). This bandwidth extension may affect the stability of the voltage regulator 100 at high load currents (e.g. at or above the threshold current).

As illustrated in FIGS. 6A (1) and 6A (2), the bandwidth of an intermediate stage 102 is typically relatively high. The compensation loop which is described in the present document is configured to reduce the bandwidth of the intermediate stage 102 (by reducing the frequency of a pole of the intermediate stage 102). This is illustrated by the arrow shown in FIG. 6A (3). As a result of this, the bandwidth extension caused by the LC resonance can (at least partially) be compensated, thereby increasing the stability of the voltage regulator 100 at high load currents (e.g. at or above the threshold current).

FIG. 6B illustrates the magnitude of the total gain of a voltage regulator 100. In particular FIG. 6B (1) shows the total gain for a voltage regulator 100 with an ideal capacitive load. FIG. 6B (2) shows the total gain for a voltage regulator 100 with uncontrolled bandwidth extension caused by an LC resonance (i.e. a non-ideal output capacitor 105). In addition, FIG. 6B (3) shows the total gain for a voltage regulator 100 which makes use of a compensation loop described in the present document. The compensation loop controls the pole of an intermediate amplification stage 102 for compensating the effects of the LC resonance at the output of the voltage regulator 100.

Figure 7:
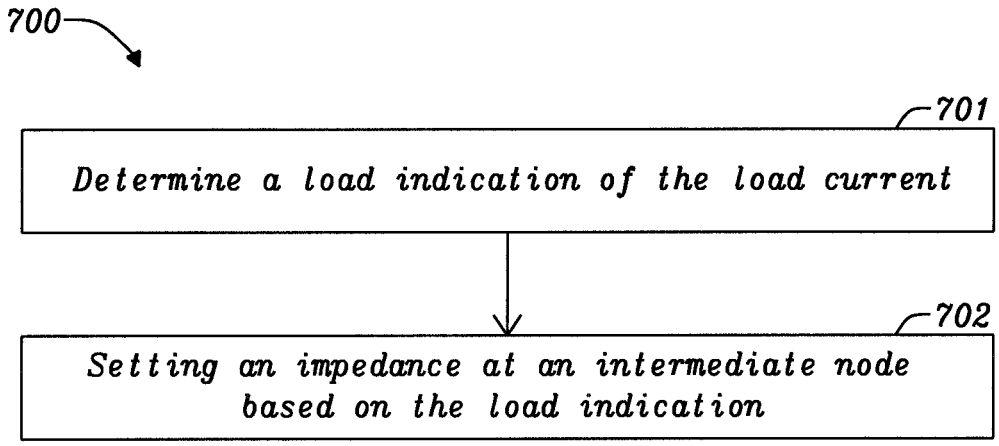
FIG. 7 shows a flow chart of an example method for compensating and/or reducing the effects caused by a parasitic inductance at the output of a voltage regulator.

FIG. 7 shows a flow chart of an example method 700 for compensating and/or reducing effects of a parasitic inductance 211, 212 at an output of a voltage regulator 100, notably an LDO. The voltage regulator 100 is configured to provide an output current at an output voltage at an output node of the voltage regulator 100, based on an input voltage at an input node of the voltage regulator 100. The input voltage may e.g. be provided by a rechargeable battery. The voltage regulator 100 may comprise a pass transistor 201 which is controlled using a feedback loop. The input node may correspond to an input port (e.g. a source or a drain) of the pass transistor 201 and the output node may correspond to an output port (e.g. a drain or a source) of the pass transistor 201. The pass transistor 201 (notably the gate of the pass transistor 201) may be controlled such that the output node is at a pre-determined output voltage. The output node of the voltage regulator 100 may be coupled to an output capacitor 106 via a conductive path that exhibits the parasitic inductance 211, 212. Hence, the voltage regulator 100 may be coupled to an LC circuit which exhibits an LC resonance frequency. This LC circuit may impact the stability of the voltage regulator 100, notably at relatively high output (i.e. load) currents. The method 700 may be directed at reducing the effects of this LC circuit on the performance and/or the stability of the voltage regulator 100.

The voltage regulator 100 comprises an output amplification stage 103 for deriving the output current at the output node from the input voltage at the input node in dependence of a drive voltage at an intermediate node of the voltage regulator 100. The intermediate node may correspond to the input of the output amplification stage 103 and/or the output of an intermediate amplifications stage. 102.

The output amplification stage 103 typically comprises the pass transistor 201 as well as a driver stage 110 for the pass transistor 201. The output amplification stage 103 may be configured to provide a frequency-dependent gain. The gain may be dependent on the output current. Typically, the roll-off frequency of the frequency-dependent gain of the output amplification stage 103 increases with increasing output current. In addition, the LC circuit at the output of the voltage regulator 100 may cause a bandwidth extension of the frequency-dependent gain of the output amplification stage 103 for relatively high output currents (at or above the threshold current).

Furthermore, the voltage regulator 100 comprises one or more intermediate amplification stages 102 for providing the drive voltage at the intermediate node based on a differential output voltage. Each intermediate amplification stage 102 may be configured to provide a frequency-dependent gain. The roll-off frequency of the gain (i.e. the frequency of a pole) of an intermediate amplification stage 102 may be higher than the roll-off frequency of the gain (i.e. the frequency of a pole) of the output amplification stage 103 (at least for output currents below the threshold current).

Furthermore, the voltage regulator 100 comprises a differential amplification stage 101 configured to determine the differential output voltage in dependence of the output voltage and in dependence of a reference voltage 108. Using a feedback network 206 (e.g. a voltage divider 104), a feedback voltage 107 may be derived from the output voltage. The differential amplification stage 101 may be configured to derive the differential output voltage based on (the difference of) the feedback voltage 107 and the reference voltage 108, in order to set the output voltage in dependence of the reference voltage 108.

The method 700 comprises determining 701 a load indication which is indicative of the output current. The load indication may be determined using one or more current mirrors, which mirror the output current. Furthermore, the method 700 comprises setting 702 (a value of) an impedance 242 at the intermediate node based on the load indication. In particular, the impedance 242 at the intermediate node may be reduced for relatively high output currents. On the other hand, the impedance 242 at the intermediate node may remain unchanged (i.e. it may correspond to the impedance of the intermediate amplification stage 102), for relatively low output currents. By doing this, the effects of a parasitic inductance 211, 212 may at least partially be compensated without (significantly) affecting the power efficiency of the voltage regulator 100.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A voltage regulator configured to provide an output current at an output voltage at an output node of the voltage regulator, based on an input voltage at an input node of the voltage regulator; wherein the output node of the voltage regulator is coupled to an output capacitor via a conductive path that exhibits a parasitic inductance; wherein the voltage regulator comprises, an output amplification stage for deriving the output current at the output node from the input voltage at the input node in dependence of a drive voltage at an intermediate node of the voltage regulator;

an intermediate amplification stage for providing the drive voltage at the intermediate node based on a differential output voltage wherein the intermediate amplification stage exhibits an amplification bandwidth;

a differential amplification stage configured to determine the differential output voltage in dependence of the output voltage and in dependence of a reference voltage;

a sensing unit configured to provide a load indication which is indicative of the output current; and a variable impedance coupled to the intermediate node; wherein the variable impedance is dependent on the load indication, wherein the variable impedance is such that the amplification bandwidth is reduced, if the load indication indicates a relatively high output current; and the amplification bandwidth remains unaffected, if the load indication indicates a relatively low output current.

2. The voltage regulator of claim 1, wherein the variable impedance is such that a magnitude of the impedance is relatively low, if the load indication indicates a relatively high output current; and the magnitude of the impedance is relatively high, if the load indication indicates a relatively low output current.

3. The voltage regulator of claim 1, wherein the output capacitor and the parasitic inductance form an LC circuit with an LC resonance frequency; and a load current dependency and/or a magnitude of the variable impedance is set based on the LC resonance frequency.

4. The voltage regulator of claim 1, wherein the variable impedance comprises a capacitor which is arranged in series with a variable resistance;

the serial arrangement of the capacitor and the resistance is arranged to couple the intermediate node to a reference potential of the voltage regulator; and the variable resistance is dependent on the load indication.

5. The voltage regulator of claim 4, wherein the variable resistance is relatively low, if the load indication indicates a relatively high output current; and relatively high, if the load indication indicates a relatively low output current.

6. The voltage regulator of claim 4, wherein the variable resistance is at least partially provided by a control transistor having a variable on-resistance; and the control transistor is controlled based on the load indication.

7. The voltage regulator of claim 1, wherein the output amplification stage comprises a drive transistor which forms a current mirror with a pass transistor;

the output current corresponds to a current through the pass transistor;

the output amplification stage comprises a first transistor which is arranged in series with the drive transistor and which forms a current mirror with a second transistor;

the output amplification stage comprises a third transistor which is controlled based on the drive voltage at the intermediate node and which is arranged in series with the second transistor; and the load indication depends on, notably corresponds to, a voltage level of gates of the first and second transistors.

8. The voltage regulator of claim 7 referring back to claim 6, wherein a gate of the control transistor is coupled to the gates of the first and second transistors.

9. The voltage regulator of claim 7 referring back to claim 6, wherein the sensing unit comprises a sensing transistor having a gate that is coupled to the gates of the first and second transistors and being arranged in series with a sensing resistor; and a gate of the control transistor is coupled to a midpoint between the sensing transistor and the sensing resistor.

10. The voltage regulator of claim 1, wherein the voltage regulator comprises a feedback network configured to provide a feedback voltage which is dependent on the output voltage; and the differential amplification stage is configured to determine the differential output voltage in dependence of the feedback voltage and in dependence of the reference voltage.

11. A method for compensating and/or reducing effects of a parasitic inductance at an output of a voltage regulator; wherein the voltage regulator is configured to provide an output current at an output voltage at an output node of the voltage regulator, based on an input voltage at an input node of the voltage regulator; wherein the output node of the voltage regulator is coupled to an output capacitor via a conductive path that exhibits the parasitic inductance; wherein the voltage regulator comprises an output amplification stage for deriving the output current at the output node from the input voltage at the input node in dependence of a drive voltage at an intermediate node of the voltage regulator; wherein the voltage regulator comprises an intermediate amplification stage for providing the drive voltage at the intermediate node based on a differential output voltage, wherein the intermediate amplification stage exhibits an amplification bandwidth; and wherein the voltage regulator comprises a differential amplification stage configured to determine the differential output voltage in dependence of the output voltage and in dependence of a reference voltage; wherein the method comprises determining a load indication which is indicative of the output current; and setting an impedance at the intermediate node based on the load indication such that:

i. the amplification bandwidth is reduced, if the load indication indicates a relatively high output current; and the amplification bandwidth remains unaffected, if the load indication indicates a relatively low output current.

12. A voltage regulator configured to provide an output current at an output voltage at an output node of the voltage regulator, based on an input voltage at an input node of the voltage regulator; wherein the output node of the voltage regulator is coupled to an output capacitor via a conductive path that exhibits a parasitic inductance; wherein the voltage regulator comprises, an output amplification stage for deriving the output current at the output node from the input voltage at the input node in dependence of a drive voltage at an intermediate node of the voltage regulator;

an intermediate amplification stage for providing the drive voltage at the intermediate node based on a differential output voltage, wherein the intermediate amplification stage exhibits a pole;

a differential amplification stage configured to determine the differential output voltage in dependence of the output voltage and in dependence of a reference voltage;

a sensing unit configured to provide a load indication which is indicative of the output current; and a variable impedance coupled to the intermediate node; wherein the variable impedance is dependent on the load indication, wherein the variable impedance is such that a frequency of the pole is reduced, if the load indication indicates a relatively high output current; and the frequency of the pole remains unaffected, if the load indication indicates a relatively low output current.

13. A voltage regulator configured to provide an output current at an output voltage at an output node of the voltage regulator, based on an input voltage at an input node of the voltage regulator; wherein the output node of the voltage regulator is coupled to an output capacitor via a conductive path that exhibits a parasitic inductance, wherein the output capacitor and the parasitic inductance form an LC circuit with an LC resonance frequency; wherein the voltage regulator comprises, an output amplification stage for deriving the output current at the output node from the input voltage at the input node in dependence of a drive voltage at an intermediate node of the voltage regulator;

an intermediate amplification stage for providing the drive voltage at the intermediate node based on a differential output voltage;

a differential amplification stage configured to determine the differential output voltage in dependence of the output voltage and in dependence of a reference voltage;

a sensing unit configured to provide a load indication which is indicative of the output current; and a variable impedance coupled to the intermediate node; wherein the variable impedance is dependent on the load indication;

Wherein the voltage regulator excluding the variable impedance exhibits a bandwidth and/or a gain bandwidth frequency which increases with increasing output current, such that for an output current at or above a threshold current the LC resonance frequency falls within the bandwidth and/or is smaller than the gain bandwidth frequency; and the variable impedance is such that for the voltage regulator including the variable impedance the LC resonance frequency is higher than the bandwidth and/or the gain bandwidth frequency of the voltage regulator at an output current at or above the threshold current; and the bandwidth and/or the gain bandwidth frequency of the voltage regulator including the variable impedance corresponds to the bandwidth and/or the gain bandwidth frequency of the voltage regulator excluding the variable impedance for an output current below the threshold current.

14. A voltage regulator configured to provide an output current at an output voltage at an output node of the voltage regulator, based on an input voltage at an input node of the voltage regulator; wherein the output node of the voltage regulator is coupled to an output capacitor via a conductive path that exhibits a parasitic inductance, wherein the output capacitor and the parasitic inductance form an LC circuit with an LC resonance frequency; wherein the voltage regulator comprises, an output amplification stage for deriving the output current at the output node from the input voltage at the input node in dependence of a drive voltage at an intermediate node of the voltage regulator;

an intermediate amplification stage for providing the drive voltage at the intermediate node based on a differential output voltage;

a differential amplification stage configured to determine the differential output voltage in dependence of the output voltage and in dependence of a reference voltage;

a sensing unit configured to provide a load indication which is indicative of the output current; and a variable impedance coupled to the intermediate node; wherein the variable impedance is dependent on the load indication;

wherein the voltage regulator excluding the variable impedance has a frequency-dependent open loop gain for an output current at or above a threshold current, which exhibits a peak around the LC resonance frequency; and the variable impedance is such that the open loop gain of the voltage regulator including the variable impedance exhibits a reduced peak or no peak around the LC resonance frequency for an output current at or above the threshold current; and corresponds to the open loop gain of the voltage regulator excluding the variable impedance for an output current below the threshold current.

15. A method for compensating and/or reducing effects of a parasitic inductance at an output of a voltage regulator; wherein the voltage regulator is configured to provide an output current at an output voltage at an output node of the voltage regulator, based on an input voltage at an input node of the voltage regulator; wherein the output node of the voltage regulator is coupled to an output capacitor via a conductive path that exhibits the parasitic inductance; wherein the voltage regulator comprises an output amplification stage for deriving the output current at the output node from the input voltage at the input node in dependence of a drive voltage at an intermediate node of the voltage regulator; wherein the voltage regulator comprises an intermediate amplification stage for providing the drive voltage at the intermediate node based on a differential output voltage, wherein the intermediate amplification stage exhibits a pole; and wherein the voltage regulator comprises a differential amplification stage configured to determine the differential output voltage in dependence of the output voltage and in dependence of a reference voltage; wherein the method comprises determining a load indication which is indicative of the output current; and setting an impedance at the intermediate node based on the load indication such that:

a frequency of the pole is reduced, if the load indication indicates a relatively high output current; and the frequency of the pole remains unaffected, if the load indication indicates a relatively low output current.

16. A method for compensating and/or reducing effects of a parasitic inductance at an output of a voltage regulator; wherein the voltage regulator is configured to provide an output current at an output voltage at an output node of the voltage regulator, based on an input voltage at an input node of the voltage regulator; wherein the output node of the voltage regulator is coupled to an output capacitor via a conductive path that exhibits the parasitic inductance, wherein the output capacitor and the parasitic inductance form an LC circuit with an LC resonance frequency; wherein the voltage regulator comprises an output amplification stage for deriving the output current at the output node from the input voltage at the input node in dependence of a drive voltage at an intermediate node of the voltage regulator; wherein the voltage regulator comprises an intermediate amplification stage for providing the drive voltage at the intermediate node based on a differential output voltage; and wherein the voltage regulator comprises a differential amplification stage configured to determine the differential output voltage in dependence of the output voltage and in dependence of a reference voltage; wherein the method comprises determining a load indication which is indicative of the output current; and setting an impedance at the intermediate node based on the load indication; wherein the voltage regulator excluding the variable impedance exhibits a bandwidth and/or a gain bandwidth frequency which increases with increasing output current, such that for an output current at or above a threshold current the LC resonance frequency falls within the bandwidth and/or is smaller than the gain bandwidth frequency; and the variable impedance is such that for the voltage regulator including the variable impedance the LC resonance frequency is higher than the bandwidth and/or the gain bandwidth frequency of the voltage regulator at an output current at or above the threshold current; and the bandwidth and/or the gain bandwidth frequency of the voltage regulator including the variable impedance corresponds to the bandwidth and/or the gain bandwidth frequency of the voltage regulator excluding the variable impedance for an output current below the threshold current.

17. A method for compensating and/or reducing effects of a parasitic inductance at an output of a voltage regulator; wherein the voltage regulator is configured to provide an output current at an output voltage at an output node of the voltage regulator, based on an input voltage at an input node of the voltage regulator; wherein the output node of the voltage regulator is coupled to an output capacitor via a conductive path that exhibits the parasitic inductance, wherein the output capacitor and the parasitic inductance form an LC circuit with an LC resonance frequency; wherein the voltage regulator comprises an output amplification stage for deriving the output current at the output node from the input voltage at the input node in dependence of a drive voltage at an intermediate node of the voltage regulator; wherein the voltage regulator comprises an intermediate amplification stage for providing the drive voltage at the intermediate node based on a differential output voltage; and wherein the voltage regulator comprises a differential amplification stage configured to determine the differential output voltage in dependence of the output voltage and in dependence of a reference voltage; wherein the method comprises determining a load indication which is indicative of the output current; and setting an impedance at the intermediate node based on the load indication; wherein the voltage regulator excluding the variable impedance has a frequency-dependent open loop gain for an output current at or above a threshold current, which exhibits a peak around the LC resonance frequency; and the variable impedance is such that the open loop gain of the voltage regulator including the variable impedance exhibits a reduced peak or no peak around the LC resonance frequency for an output current at or above the threshold current; and corresponds to the open loop gain of the voltage regulator excluding the variable impedance for an output current below the threshold current.

* * * * *